United States Patent [19]

Lees

[11] 3,965,829

[45] June 29, 1976

[54] BOILER

[75] Inventor: Byrom Lees, Kent, England

[73] Assignee: The British Petroleum Company Limited, London, England

[22] Filed: Feb. 3, 1975

[21] Appl. No.: 546,758

[30] Foreign Application Priority Data

Feb. 25, 1974 United Kingdom ..... 8372/74

[52] U.S. Cl. ..... 110/22 R; 110/28 L; 110/49 R

[51] Int. Cl.[2] ..... F23C 1/10; F23J 5/02

[58] Field of Search ..... 110/49 R, 28 L, 28 K, 110/22 R, 22 A; 122/4; 431/115

[56] References Cited

UNITED STATES PATENTS

| | | | |
|---|---|---|---|
| 762,129 | 6/1904 | Branch | 431/115 |
| 2,495,550 | 1/1950 | Ruegg | 110/49 |
| 2,917,011 | 12/1959 | Korner | 110/165 |
| 3,369,587 | 2/1968 | Taubmann | 431/115 |
| 3,838,652 | 10/1974 | Schol | 110/49 |

*Primary Examiner*—Kenneth W. Sprague
*Attorney, Agent, or Firm*—Morgan, Finnegan, Pine, Foley & Lee

[57] ABSTRACT

An oil fired heating plant has a boiler and a cyclone for trapping flue dust. The flue dust is continually recirculated from the cyclone back to the boiler by, for example, a fan. The recirculated flue dust is passed into the primary air supply of the oil burner being used in the boiler.

9 Claims, 2 Drawing Figures

BOILER

This invention relates to oil-fired plant and more particularly to residue recirculation in said plant.

During the combustion of oil in oil-fired plant, the resulting flue dust may be collected in grit arrester or cyclones fitted on the plant. An example of the use of a cyclone is described in our British Patent No. 1,372,689. The disposal of this flue dust, particularly at large plant e.g. power station boilers, presents handling and disposal problems.

According to the invention there is provided an oil-fired heating plant comprising a combustion chamber having an oil burner, and a cyclone capable of trapping flue dust, there being a flue dust recirculator between the base of the cyclone and the air inlet of the oil burner. In this manner, the recirculated flue dust is partially or wholly consumed in the flame of the burner.

The flue dust recirculator preferably comprises a pipe connected from the base of the cyclone to the boiler, or other oil-fired plant said pipe having suction means incorporated. The pipe between the base of the cyclone and the boiler or other plant is preferably lagged.

In one embodiment of the invention, the suction means comprises a fan in the pipe and preferably also a valve e.g. a regulating valve in line to enable secondary air to be allowed into the flue dust supply for cooling purposes.

In a second embodiment, the suction means for passing the flue dust from the cyclone to the boiler or other plant comprises a compressed gas (air) injector which entrains flue dust causing it to flow towards the boiler or other plant.

According to a further aspect of the invention there is provided a method of recirculating flue dust from oil-fired heating plant wherein flue gases containing flue dust from the combustion chamber of the oil-fired plant are passed into a cyclone capable of trapping flue dust, the flue dust being recirculated from the base of the cyclone to the air inlet of the oil burner of the combustion chamber along a line having recirculating means, for example, a fan.

The suction means preferably pass the flue dust into the forced draught fan supplying the primary combustion air to the boiler or directly into the air inlet of the oil burner. The flow rate of the recirculating gases is sufficiently high so as to maintain the flue dust in suspension.

The invention will now be described by way of example with reference to FIGS. 1 and 2 of the accompanying drawings.

Figure 1:
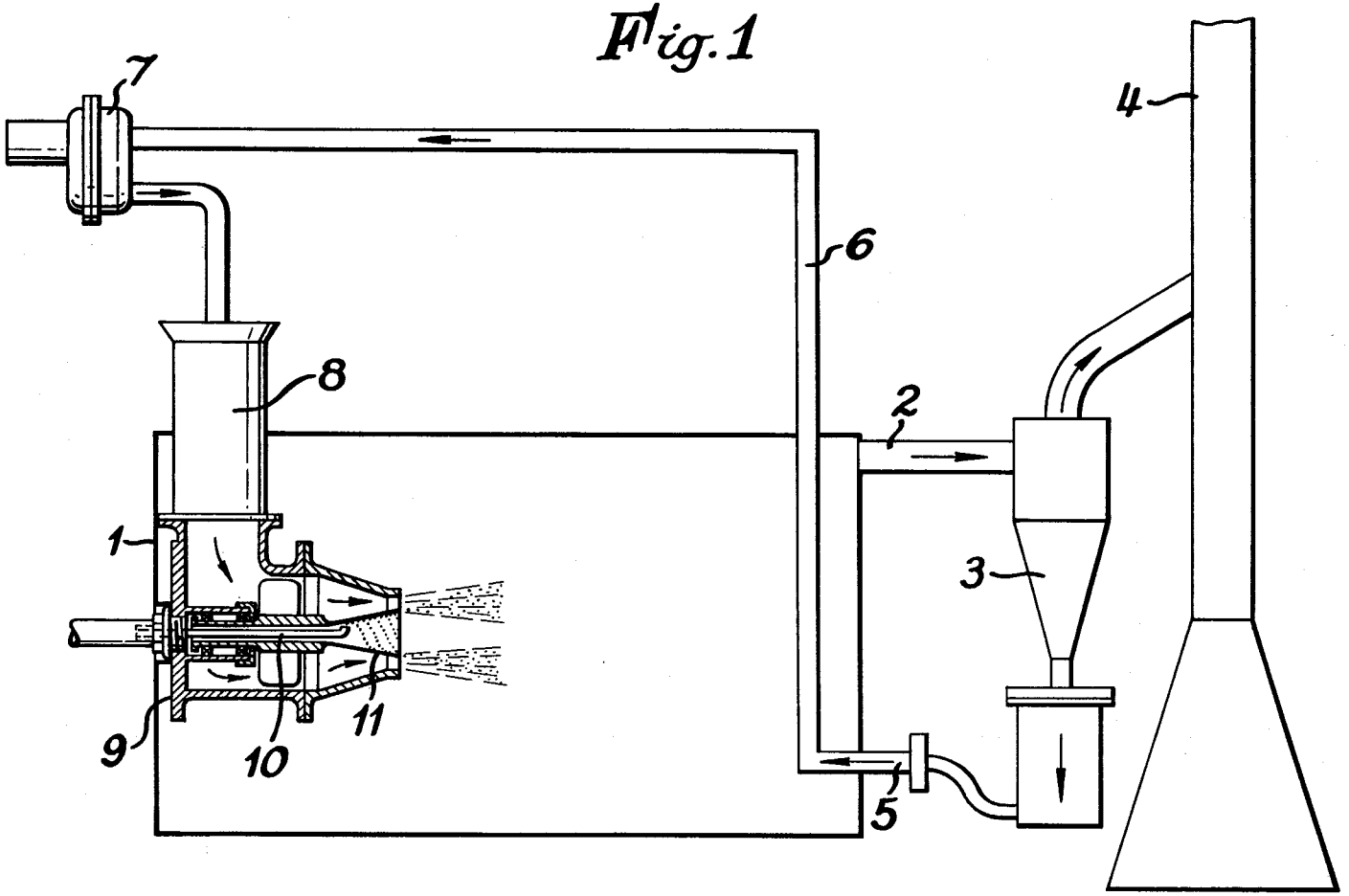
FIG. 1 shows a diagrammatic representation of a packaged boiler using a mechanical atomising oil burner and having grit and dust recirculation.

FIG. 1 shows an oil-fired packaged boiler 1 capable of burning 1 ton of fuel oil per hour, connected via a boiler exhaust 2 to the cyclone 3 having a chimney 4. A recirculating pipeline 5 (of 2 inch diameter) which is heavily lagged to prevent acidic condensation passes from the base of the cyclone 3 back into the boiler 1. The pipeline 5 passes into a second lagged pipe 6 having a small fan 7. The boiler 1 also has forced draught fans 8 which provide combustion air for the fuel, the small fan 7 thus being able to pass recirculated flue gas from pipe 6 into the primary air flow.

Forced draught fans 8 provide the primary air supply for the burner used in the boiler. The burner 9 is an atomising oil burner which divides the fuel oil into small droplets necessary for good combustion. The particular burner used is of the mechanical atomising type. The oil passes through an oil supply tube 10 and is delivered to the inside of a hollow cone 11 which is rotated at high speed. The cone imparts a rotary motion to the fuel oil. The centrifugal forces causes an oil film to form on the inside which is eventually flung off the edge of the cone to form droplets which are carried into the combustion chamber by the combustion air supply from pipe 6.

During use of the boiler, the resultant flue gases pass via exhaust 2 into the cyclone 3. The flue dust is withdrawn by the fan 7, together with some flue gases, down the narrow bore recirculating pipe 5. It is then re-injected after dilution with air by means of valve 9, the gas at reduced temperature, say 50°C, being passed by fan 7 into the forced draught fans 8 of the boiler. The recirculated flue gases contained flue gases containing flue dust are then passed into the air inlet of the mechanical atomising burner. The fan 7 only operates when the forced draught fans 8 operate.

The boiler used was a 3000 lb steam/hour MCR Multipac unit and 3500 sec (Redwood viscosity) heavy fuel oil was burned. The solids recycling fan was based on a two stage centrifugal air blower unit. The motor of the unit was 240 volt AC/DC universally wound brush type having a speed of 16000 rpm.

Stack solids were measured both before and after the cyclone and the quantity of solids retained in the cyclone hopper was measured. Measurements were made both with and without the solids recycling system operating.

The boiler operating conditions and results are shown in Table 1:

TABLE 1

| Fuel Oil Consumption | 75kg/h | | 49kg/h | |
|---|---|---|---|---|
| Method of Operation | With Recycling | Without Recycling | With Recycling | Without Recycling |
| Flue gas oxygen (%) | 5.0 | 6.5 | 5.8 | 6.2 |
| Solids before cyclone (% wt of fuel) | 0.134 | 0.151 | 0.069 | 0.068 |
| Solids after cyclone (% wt of fuel) | 0.022 | 0.027 | 0.026 | 0.034 |
| Collecting efficiency (%) | 84 | 82 | 62 | 50 |
| Solids in hopper g. per/h (Estimated) | 0 | 95 | 0 | 17 |
| Flow rate of recycled | 55 | 0 | 55 | 0 |

TABLE 1-continued

| Fuel Oil Consumption | 75kg/h | 49kg/h |
|---|---|---|
| flue gas ($m^3/h$) | | |

Figure 2:
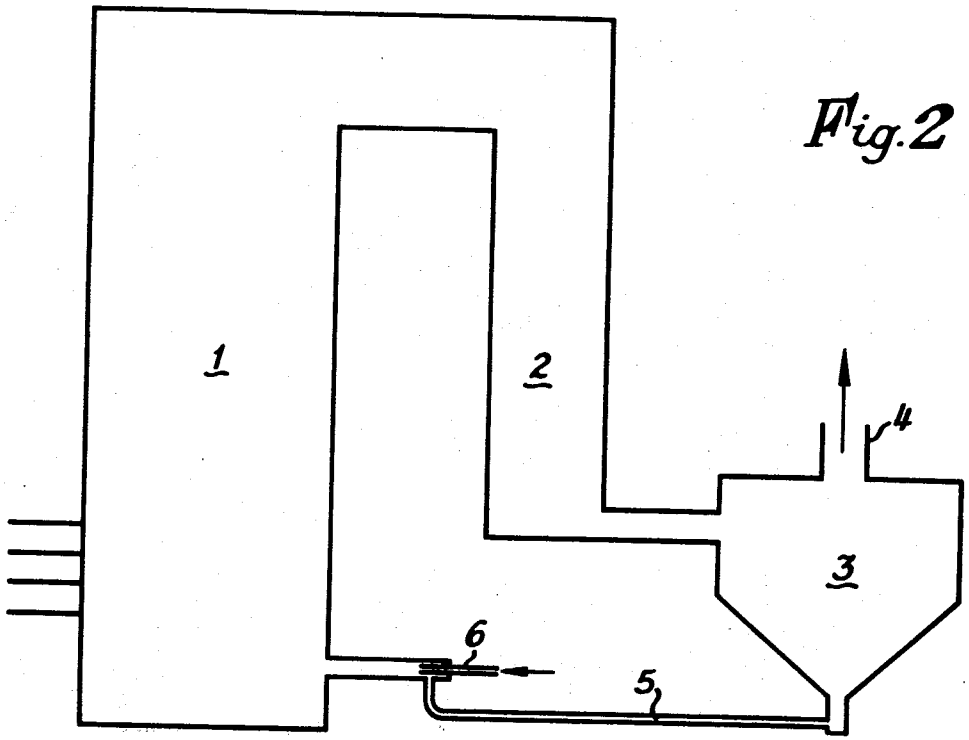
FIG. 2 shows a diagrammatic representation of a water tube boiler having grit and dust recirculation.

FIG. 2 shows a water tube boiler capable of burning 100 tons of fuel oil per hour, having a further method of grit and dust recirculation.

During use of the boiler 1, the flue gases pass via exhaust 2 into the cyclone 3. The flue dust is withdrawn via the lagged pipe 5 by the suction from an ejector 6 using a source of compressed air. The dust and air pass into the back of the combustion chamber or air inlet of the oil burner where they are burned.

The resulting system of recirculation of flue dust is automatic, the injector or injector fan only operating whilst the plant is fired. Flue dust handling and disposal is eliminated and there may be a small gain in plant efficiency.

An air dilution valve may be incorporated into the pipeline 5 if necessary. This enables some cooling of the flue gas to be made so as to avoid overheating of the motor of fan 7.

I claim:

1. An oil-fired heating plant comprising a combustion chamber, an oil burner having a combustion air inlet, said oil burner being located in said combustion chamber, a cyclone means for trapping and collecting flue dust and means for cycling flue dust collected in said cyclone means back into said combustion air inlet of said oil burner.

2. A heating plant according to claim 1 in which the flue dust cycling means comprises a conduit extending between the base of the cyclone and the air inlet of the oil burner and suction means are located in said conduit means.

3. A heating plant according to claim 2 in which the suction means comprises a fan.

4. A heating plant according to claim 3 in which the fan is a centrifugal air blower.

5. A heating plant according to claim 2 in which the suction means comprises a compressed gas injector adapted to entrain flue dust.

6. A heating plant according to claim 2 in which the conduit between the base of the cyclone and the combustion chamber is lagged.

7. A method of disposal of combustible flue dust from an oil fired heating plant comprising the steps of: (i) passing flue gasses containing combustible flue dust from an oil fired burner combustion chamber into a cyclone; (ii) trapping and collecting said flue dust in the cyclone; (iii) recirculating the collected flue dust to the air inlet of the oil burner; and (iv) injecting the flue dust into said air inlet, whereby the flue dust is burned in the heating plant.

8. A method according to claim 7 in which the flue dust is recirculated by suction means.

9. A method according to claim 7 in which the flue dust is recirculated by use of a compressed gas injector to entrain flue dust and thereby transport it back to the air inlet of the oil burner.

* * * * *